United States Patent [19]

Okayama et al.

[11] 3,951,577

[45] Apr. 20, 1976

[54] APPARATUS FOR PRODUCTION OF METAL POWDER ACCORDING WATER ATOMIZING METHOD

[75] Inventors: Akira Okayama; Hisashi Ando; Ko Soeno, all of Hitachi; Hisasuke Takeuchi, Omiya; Atsuya Kamada, Yokohama, all of Japan

[73] Assignees: Hitachi, Ltd.; Hitachi Metals, Ltd., both of Japan

[22] Filed: Feb. 11, 1974

[21] Appl. No.: 441,357

[30] Foreign Application Priority Data

Feb. 9, 1973 Japan ..... 48-15523

[52] U.S. Cl. ..... 425/7; 266/202

[51] Int. Cl.[2] ..... B22D 23/08

[58] Field of Search ..... 266/34 R; 425/7

[56] References Cited

UNITED STATES PATENTS

| | | | |
|---|---|---|---|
| 720,382 | 2/1903 | Rowley | 425/7 X |
| 3,340,334 | 9/1967 | Feldmann et al. | 425/7 X |
| 3,551,532 | 12/1970 | Laird | 425/7 X |
| 3,588,951 | 6/1971 | Hegmann | 425/7 |
| 3,692,443 | 9/1972 | Lightner | 425/7 |
| 3,814,558 | 6/1974 | Ayers | 425/7 |

FOREIGN PATENTS OR APPLICATIONS

| | | | |
|---|---|---|---|
| 638,581 | 6/1950 | United Kingdom | 425/7 |

*Primary Examiner*—Gerald A. Dost
*Attorney, Agent, or Firm*—Craig & Antonelli

[57] ABSTRACT

This invention relates to an apparatus for production of metal powders of a low oxygen content, which are preferred as raw material powders for sintered bodies of a high toughness, according to the water atomizing method. More specifically, when a molten metal is sprayed in a limited space with use of a liquid crystal medium and cooled promptly, a metal powder results of a good moldability which has an oxygen content corresponding to ½ or less of the oxygen contents of metal powders prepared by conventional apparatuses and which is excellent in the size uniformity.

26 Claims, 5 Drawing Figures

FIG. 4
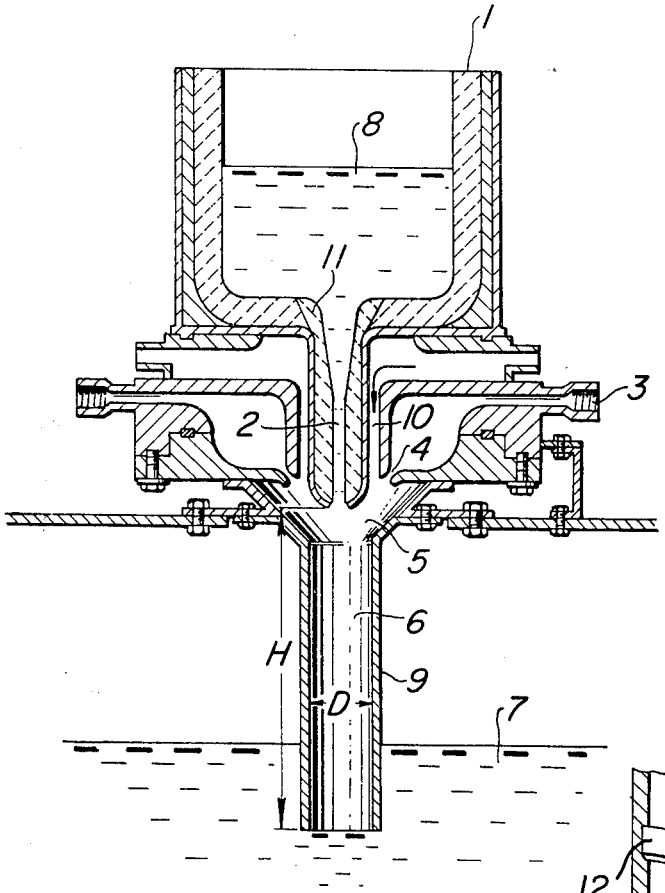
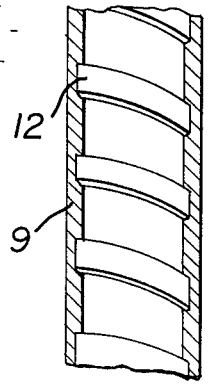
FIG. 5

APPARATUS FOR PRODUCTION OF METAL POWDER ACCORDING WATER ATOMIZING METHOD

BACKGROUND OF THE INVENTION

When steels of a high carbon content such as tool steel are molten in an electric furnace and cast into an ingot case, carbides are crystallized out from the melt and they are likely to become coarse with a non-uniform distribution. Therefore, it is generally impossible to obtain required quenching and mechanical properties. It has been conducted to subject an ingot to the homogeneous heat treatment and hot processing to finely divide carbides and distribute them uniformly. Even if such treatment is conducted, it is difficult for the treated product to exert properties inherent of the material sufficiently. Especially when the ingot is large, formation of coarse carbides is enhanced, resulting in extreme reduction of the abrasion resistance or toughness.

Accordingly, a sintered body prepared by molding and sintering a powder formed by spraying a molten steel has been investigated. When a molten steel is sprayed into a spray medium, since fine particules of the sprayed metal are rapidly cooled, carbides formed at the solidification of the metal are very fine and dispersed uniformly in the solidified metal. If it is possible to prepare a sintered product having a density approximating the theoretical density by molding the so formed powder into a desired form and hot pressing it at such a high temperature as ranging from 900° to 1200°C., a sintered product having very excellent properties will probably be obtained.

Problems involved in the powder metallurgy are the oxygen content in the metal powders and the shape of the metal powders. Because of a large surface area of metal powders, even in the case of a thin oxide film, the total amount of oxygen contained in the powders is extremely high. Especially when a component having a high affinity with oxygen such as chromium or vanadium is contained in the metal, the oxygen content tends to increase, and the toughness of the material is readily degraded, with the result that the effect owing to dispersing carbides finely and uniformly is lost. For example, the impact value of a high speed steel manufactured by power metallurgy (corresponding to JIS SKH 57 steel or JIS BS BT 42 steel) varies greatly depending on the oxygen content, and although at an oxygen content not exceeding 100 ppm the impact value is higher than 2 kg-m/cm$^2$, at an oxygen content exceeding 200 ppm the impact value is reduced below 1.7 Kg-m/cm$^2$. A high speed steel of the same composition prepared by melting has a low oxygen content of about 50 ppm owing to the coarse size and non-uniform distribution of carbides, but its impact value is as low as about 1 Kg-m/cm$^2$.

An irregular shape is suitable for molding by powder metallurgy, and a metal powder having a globular or drop-like shape is poor in moldability and it cannot be used as it is. However, when a spherical powder is mechanically pulverized so as to change its form into irregular one, incorporation of impurities or pollution of air by dust is caused to occur. Therefore, it is desired that such mechanical pulverization method is not adopted.

In the atomizing method for preparing a metal powder, it is known that a metal powder of such a low oxygen content as about 100 ppm can be prepared by employing argon gas as a spray medium and conducting the atomizing process in an inert gas atmosphere. However, this technique involves a difficulty in attainment of an air-tight structure and a problem of a high manufacturing cost caused by consumption of argon gas. Further, this technique is fatally defective in that the resulting powder has a spherical shape and hence, is poor in moldability. In case a gas is used as a spray medium, since the volume of the gas is greatly expanded on departure from a spray nozzle, a high effect of pulverizing molten metal cannot be obtained and the resulting powder has a size distribution including large quantities of coarse particles. Further, since the inert gas has generally a low specific heat, it takes a long time for liquid drops of the molten metal to be solidified and they tend to have a spherical shape. Simultaneously, crystals of metal grow during solidification and the composition of precipitates differs between the inner layer and outer layer of the metal particle.

As noted above, atomized powders formed with use of inert gases have an advantage of a low oxygen content, but they are defective in other various points and they are not suitable for practical use.

When water is used as a spray medium in the atomizing method, because of its high activity of finely dividing molten metal and its high specific heat, water gives fine metal particles irregular in the shape while exhibiting a rapid cooling effect. In customary water atomizing methods, the average dendrite arm spacing is almost constant and about 1 $\mu$m in metal particles having a particle size of 50 to 300 $\mu$m. This feature is very advantageous when it is intended to prepare a sintered body having a uniform texture, but because of occurrence of the reaction between molten metal and water, the oxygen content is increased in the resulting metal powder. It has heretofore been impossible to prepare a metal powder of an oxygen content lower than 1500 ppm according to the water atomizing method. Accordingly, methods of reducing the oxygen content of 2000 ppm or higher in metal powders prepared according to the water atomizing below 500 ppm have been proposed and conducted. For instance, there have been conducted methods in which a high carbon content alloy such as tool steel is prepared by heating metal powder in advance in a hydrogen atmosphere or incorporating into metal powder an excessive amount of carbon, pre-molding the powder under compression and heating it in vacuum at 900° to 1250° C. for a long time thereby to reduce oxygen bonded to the metal powder surface with excessive carbon.

However, when such heat treatment is conducted for a long time, carbides grow and agglomerate, and therefore, the inherent advantages attained by adoption of the sintering method are greatly reduced. Further, in some cases, the carbon content differs between the surface layer and inner layer of the resulting sintered body and it is impossible to obtain a product having a uniform composition. Moreover, in the above reducing treatment, it is necessary to maintain the metal powder in a prescribed atmosphere until the metal powder is cooled completely to room temperature, with the result that it is impossible to increase the production efficiency.

Accordingly, development of a process that can provide metal powders of a low oxygen content while utilizing fully advantages of the water atomizing method has been greatly demanded in the art.

SUMMARY OF THE INVENTION

It is a primary object of this invention to provide an apparatus for production of metal powders which can reduce the oxygen content in metal powders prepared by the liquid atomizing method very greatly as compared with the conventional techniques and which can improve greatly the manufacturing rate. Another object of this invention is to provide a metal powder which is uniform in the particle size and composition, has a fine crystal size and is very suitable for preparing a sintered body by powder metallurgy. Still another object of this invention is to provide a high carbon content alloy tool steel of a low oxygen content which can give a sintered tool steel of good quality.

In accordance with this invention, there is provided an apparatus for production of metal powders according to the metal atomizing method, which comprises a plurality of spray nozzles disposed in the peripheral portion of a molten metal nozzle, an atomizing chamber for forming fine particles of molten metal and a granulation chamber having a limited space for cooling fine metal particles. In a preferred embodiment of this invention, an opening for projecting an inert gas is disposed in the vicinity of the molten metal nozzle, and in this preferred embodiment is possible to obtain a metal powder of a much lower oxygen content.

BRIEF DESCRIPTION OF THE DRAWINGS

FIG. 4 is a view illustrating the section of another embodiment of the apparatus of this invention for preparing a metal powder according to the water atomizing method, which has an opening 10 for projecting a non-oxidizing gas which is disposed between a molten metal nozzle and a liquid spray nozzle.

FIG. 5 is a sectional view of the granulation chamber provided in another embodiment of the present invention in accordance with which the granulation chamber guide defines a system of grooves.

DESCRIPTION OF THE PREFERRED EMBODIMENTS

Figure 1:
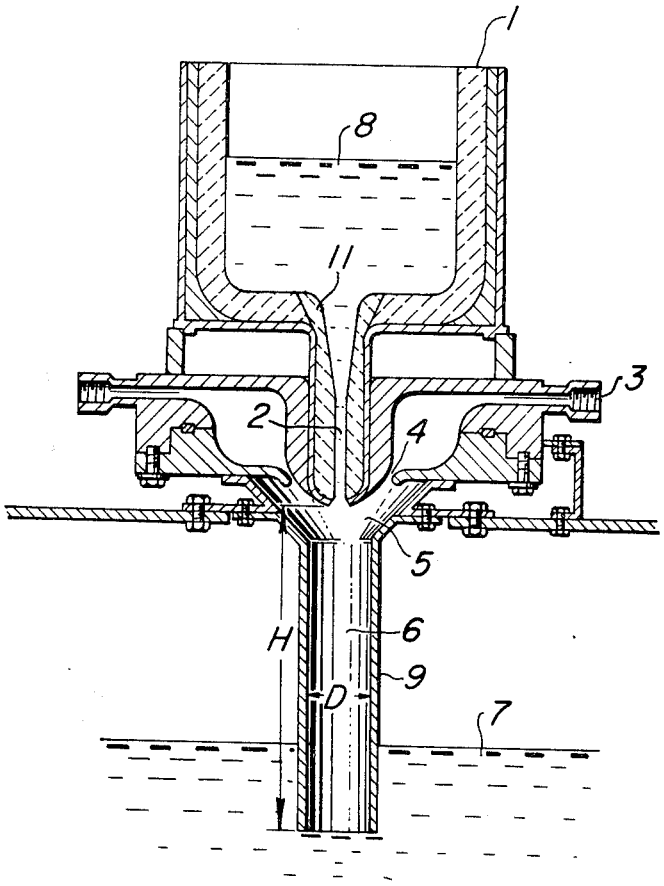
FIG. 1 is a view illustrating the section of one embodiment of the apparatus of this invention for preparing a metal powder according to the water atomizing method.

The liquid spray apparatus of this invention has an atomizing zone in which a molten metal is projected from a molten metal nozzle disposed in the lower portion of a molten metal tank, in the state finely divided by suction caused by a high speed movement of a liquid used as a spray medium, and a granulation zone in which the so finely divided molten metal particles are cooled and solidified. The apparatus of this invention will now be described by reference to an embodiment shown in FIG. 1.

Molten metal is charged into a molten metal tank 1 and is flown downwardly through a molten metal nozzle 2. A liquid spray medium is fed from a liquid feed tube 3, passed through a spray nozzle 4 for projecting the liquid downwardly in the vicinity of the molten metal nozzle and introduced in the form of a jet stream into an atomizing chamber 5. Since the liquid spray medium is projected from the spray nozzle at a high speed, the pressure is reduced in the vicinity of the opening of the molten metal nozzle 2 and hence, the speed of the molten metal passing through the molten metal coming from the molten metal nozzle 2 is blown away, atomized and finely divided by the liquid spray medium. The finely divided molten metal is vigorously agitated and mixed along the moving direction of the liquid in the state enwrapped in the liquid having a large heat capacity, and is introduced into a cylindrical granulation chamber 6. The granulation 6 has a space of a limited cross-sectional area, and violent movements of the finely divided metal and the liquid are caused, whereby a vapor film of the spray medium liquid formed on the finely divided metal surface is promptly destroyed and a fresh portion of the liquid is contacted with the metal surface, with the result that the heat retained by the metal is transferred to the liquid and the metal particles are rapidly cooled and solidified. Portions of metal particles that have not been sufficiently cooled are cooled by the stagnant liquid present in a liquid reservoir 7 connected to the lower portion of the granulation chamber.

When a high-melting-point metal is sprayed, if the molten metal nozzle is disposed in the vicinity of the spray nozzle, it sometimes happens that the molten metal is cooled and solidified in the molten metal nozzle by the liquid of the spray medium. Therefore, in the conventional apparatuses, both the nozzles are mounted greatly spaced from each other. In the apparatus of this invention, however, since the atomizing chamber in which the pressure is reduced is disposed below the molten metal nozzle and the molten metal in the nozzle is forcibly passed through the molten metal nozzle by means of suction, even if the molten metal nozzle is disposed in the vicinity of the spray nozzle, clogging of the molten metal nozzle by the solidified metal is not at all caused.

The atomizing chamber 5 and subsequent granulation chamber 6 are shut from outer air by a sealing action of the molten metal 8 and the liquid reservoir. In some cases, however, air is left in the interior of the granulation chamber at the start of the atomizing operation and the oxygen content is slightly increased in the resulting fine metal particles. Even in such cases, if the atomizing operation is continued for a certain period, residual oxygen gas is substantially expelled, and both the chambers are filled with the vapor of the spray medium liquid. If the atomizing operation is continued while maintaining this state, a metal powder of a low oxygen content can be obtained.

As means for removing oxygen from the atomizing chamber 5 and granulation chamber 6 prior to initiation of the atomizing operation, there is preferably adopted a method comprising inserting a plate of a low-melting-point metal into the molten metal nozzle portion to clog the molten metal nozzle and projecting the liquid from the spray nozzle, whereby the gas is expelled out of the system together with the liquid fluid. When the molten metal is charged into the molten metal tank after the gas has been thus removed, the low-melting-point metal is melted by the heat of the molten metal and the molten metal nozzle is opened again. Thus, it is made possible to obtain a metal powder of the intended composition from the initial stage of the operation.

The shape of the spray nozzle for projecting the spray medium should be chosen appropriately in due consideration of such factors as the sucking force imposed on the top end of the molten metal nozzle, the flow rate of the molten metal, the amount of the spray medium and the like. In this invention, a ringed spray nozzle opening is disposed circularly around the molten metal nozzle so that the center line of the spray nozzle is in agreement with the center line of the molten metal nozzle or slightly deviated from the center line of the molten metal nozzle. By such disposition it is made possible to readily cause the rotary movement of the spray medium with the molten metal nozzle as the center of the rotation. If spray nozzle openings are disposed in a plurality of circular rows and the projection angle is varied in each circle of the nozzle openings, the effect of cooling molten metal particles is enhanced and hence, the amount of the molten metal fed from the molten metal nozzle can be increased.

The granulation chamber 6 is formed in a limited space defined by a cylindrical granulation chamber guide 9. The guide 9 has a form of a cylinder or polygonal column, and its equivalent diameter is varied depending on the amount of the spray medium. When the equivalent diameter of the guide 9 is too large, fine metal particles are sedimented in stagnant water before they are sufficiently cooled by the spray medium and the amount of oxygen present on the particle surface is increased. Metal particles of a high temperature present in stagnant water are enwrapped with a water vapor film and the cooling rate is further lowered, with the result that oxygen is allowed to diffuse on the metal surface and a thick oxide film is formed. In contrast, if fine metal particles impinge violently against the liquid spray medium, the water vapor film is destroyed and the metal is simultaneously cooled. Accordingly, there is no time for oxygen to diffuse and formation of a thick oxide film can be prevented. If a spiral groove is formed in the inner surface of the guide as shown at 12 in FIG. 5 or a baffle plate or partition wall is provided in the guide, the direction of the water stream is changed in the guide and the effect of cooling fine metal particles is enhanced.

In order to prevent intrusion of air into the atomizing chamber or the granulation chamber, it is necessary to maintain a water-seal structure at the lower end of the granulation chamber. This water-seal structure can be attained by immersing the top end of the granulation chamber guide into water and maintain the distance between the water level and the top end of the molten metal nozzle within a certain range. If the distance between the top end of the molten metal nozzle and the water level is too large, the oxygen content tends to increase in fine metal particles. Further, if the equivalent diameter of the granulation chamber guide is too great, the oxygen content similarly increases. Moreover, reduction of the pressure of projecting the spray medium results in increase of the oxygen content.

When fine metal particles of a high temperature come to have a contact with water, they are spattered in random directions by a force of bumping-like boiling. If the projection force of the spray medium is weak at this point, spattered particles are fled away from the stream of the cooling medium. Further, if the size of the granulation chamber is too great, there is formed a portion in which the cooling medium is not flown, and cooling of particles introduced in this portion is much retarded to allow the oxidation reaction to proceed, resulting in increase of the oxygen content. Accordingly, it is indispensable that the granulation chamber should be so constructed that flying of fine metal particles can be completely prevented and the entire interior of the granulation chamber is filled with a strong water stream.

In one preferred embodiment of this invention, a non-oxidizing gas is sprayed in addition to water as the spray medium, and the effect of reducing the oxygen content is further enhanced. In this embodiment, the atomizing is accomplished mainly by water projected, and the gas is introduced from an intermediate portion between the molten metal nozzle and the spray nozzle, whereby cooling of the molten metal by direct splashing of water on the molten metal nozzle is prevented, the change of the sucking force caused by the spray medium is absorbed and the reaction between the high temperature metal and water is inhibited. Especially when argon or nitrogen gas is introduced as the non-oxidizing gas to increase the partial pressure of argon or nitrogen in the atmosphere, decomposition of water is inhibited and the reaction of oxidizing the metal with water can be effectively prevented.

EXAMPLE 1

A powder of a high speed steel was prepared by employing a metal powder-preparing apparatus having atomizing and granulation chambers below the molten metal nozzle, such as shown in FIG. 1. The resulting powder had a composition of JIS SKH-9 (corresponding to AISI M2). Namely, it had a chemical composition on the weight basis of 0.85 % C, 4.19 % Cr, 6.03 % W, 5.22 % Mo and 1.85 % V, the balance being Fe.

A raw material prepared so that the product would have the above chemical composition was molten in an electric furnace and charged into a molten metal tank maintained at 950°C. Atomization was carried out by employing water as the spray medium. The water pressure imposed on a spray nozzle was 60 Kg/cm$^2$, the water feed rate was 40 *l*/min and the flow rate of water passing through the nozzle was 76 m/sec. The inner diameter of the molten metal nozzle was 4 mm and the inner diameter of the granulation guide was 40 mm. The distance (H) between the top end of the molten metal nozzle and the water level was adjusted to 50 cm or 120 cm.

The oxygen content of the resulting powder, the time required for 3 Kg of the molten metal to be flown out and the yield of particles of a size not exceeding 100 mesh were determined.

For comparison, the above procedures were repeated in the same manner except that no granulation chamber guide was provided, and the above factors were similarly determined to evaluate the effect attained by provision of the granulation chamber guide. Results are shown in Table 1.

Table 1

| Inner diameter of guide (mm) | H = 50 cm Oxygen content (ppm) | Time for flown out molten metal (sec/3Kg) | Yield of particles of size not exceeding 100 mesh (%) | H = 120 cm Oxygen content (ppm) | Time for flowing out molten metal (sec/3Kg) | Yield of particles of size not exceeding 100 mesh (%) |
|---|---|---|---|---|---|---|
| 40 | 600–750 | 6–8 | 89–91 | 1150–1210 | 6–8 | 79–83 |
| ∞ | 3010–3980 | 22–23 | 85–86 | 4340–4810 | 21–23 | 82–85 |

As is seen from the foregoing results, when the guide diameter is ∞, namely when no guide is provided, the oxygen content increases extremely in the resulting powder and it is 4 – 5 times as high as the oxygen content obtained in the case where a guide of an inner diameter of 40 mm is provided. Further, when such guide is provided, the time for flowing out the molten metal can be shortened to about one-third. Thus, it will readily be understood that when a guide is provided, a great sucking force is generated at the top end of the molten metal nozzle. From the above results, it is also seen that the size distribution of the powder is not influenced by provision of the guide. In conclusion, the oxygen content of the resulting powder is greatly influenced by the inner diameter (D) of the granulation chamber guide and the distance (H) between the top end of the molten metal nozzle and the water level.

EXAMPLE 2

Figure 2:
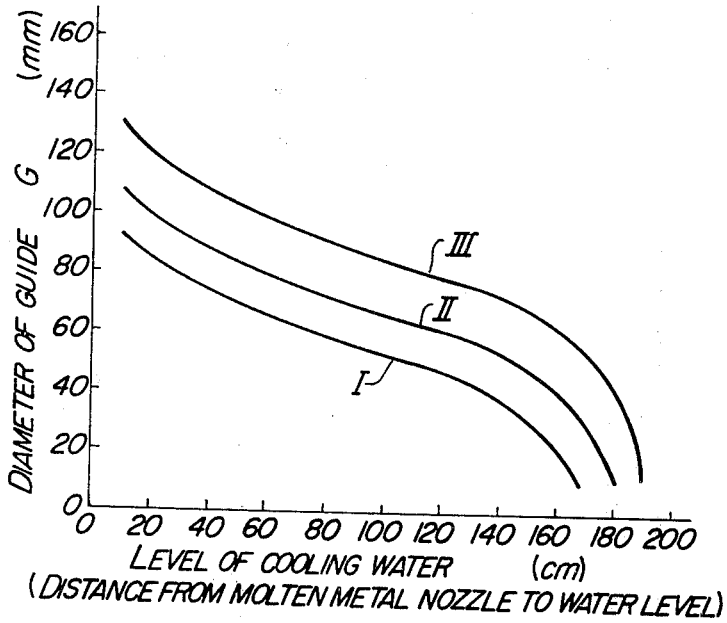
FIG. 2 is a view illustrating the relation between the equivalent diameter of the granulation chamber gride and the distance between the molten metal nozzle and the water level, observed when a metal powder of an oxygen content of 1300 ppm is prepared, in which curve 1 shows the results obtained when the flow rate of cooling water is 76 m/sec on passage through the nozzle, curve 2 shows the results obtained when said flow rate is 100 m/sec and curve 3 shows the results obtained when said flow rate is 160 m/sec.
Figure 3:
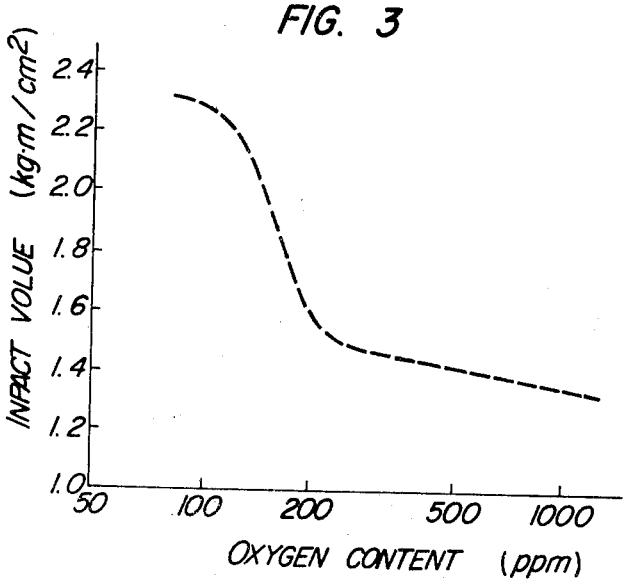
FIG. 3 is a view illustrating an instance of the relation between the impact value of a sintered body formed from powder of a high speed steel (JIS SKH-57) and the oxygen content.

The same steel component as used in Example 1, namely high speed steel SKH-9, was atomized at a spray medium water pressure of 60 Kg/cm² with a use of a molten metal nozzle having a diameter of 4 mm while changing the flow rate (flow amount) of the spray medium, the equivalent diameter [4 × (sectional area of flow)/(length of stream-contacting periphery)] of the guide and the distance between the molten metal nozzle and the water level as indicated below. In each case the oxygen content of the resulting powder was determined, and atomizing conditions giving an oxygen content of 1300 ppm, which is preferable for preparing a sintered body of good quality, were pursued. Results are shown in FIG. 2, where curve 1 indicates results obtained at a spray medium flow rate of 76 m/sec., curve 2 indicates results obtained at a spray medium flow rate of 100 m/sec. and curve 3 indicates obtained results at a spray medium flow rate of 160 m/sec. Namely, on each of curves 1, 2 and 3, the above-mentioned preferred oxygen content can be obtained and under conditions below each of these curves an oxygen content lower than 1300 ppm is obtained.

From the results shown in FIG. 2, it is seen that in order to reduce the oxygen content in the resulting metal powder, it is necessary to heighten the flow rate of the spray medium, make the equivalent diameter of the guide smaller and shorten the distance between the molten metal nozzle and the water level. However, if the equivalent diameter of the guide is smaller than 10 mm, water stays in the guide and uniform atomizing cannot be attained. Further, the molten metal-treating efficiency becomes insufficient. Accordingly, too small an equivalent diameter of the guide is not preferred. It is indispensable that the distance between the molten metal nozzle and the water level should be at least 10 cm. If this distance is shorter than 10 cm, water is blown up onto the molten metal nozzle surface and clogging of the molten metal nozzle is frequently caused. Further, the particles are not sufficiently cooled while they are passing through the granulation chamber, and fine metal particles of a high temperature sink in stagnant water. In such case, it is possible to increase the cooling effect by violently agitating stagnant water collected below the granulation chamber, but from the economical viewpoint, it is preferred that only such a water stream as withdrawing sedimented fine metal particles from the apparatus system is formed in the collected water.

From the foregoing results, it can be concluded that when it is intended to prepare a cutting tool steel, it is preferred that the equivalent diameter of the granulation chamber guide is 20 – 80 mm and the distance between the molten metal nozzle and the liquid level is 20 to 160 cm.

EXAMPLE 3

High speed steel SKH-9 was atomized at a spray medium water pressure of 60 Kg/cm², a flow rate of 76 cm/sec. and a water feed rate of 400 *l*/min. while adjusting the equivalent diameter of the guide and the distance between the molten metal nozzle and the water level to 50 mm and 80 cm, respectively. The diameter of the molten metal nozzle was varied as 3, 5, 12 and 24 mm. In each case, the oxygen content of the resulting metal powder was within a range of from 1,000 to 1,300 ppm, and it was confirmed that when the diameter of the molten metal nozzle is within a range of from 3 to 24 mm, the oxygen content is not particularly influenced by the diameter of the molten metal nozzle.

EXAMPLE 4

Powders of pure copper, pure nickel and pure iron (0.05 % C, 0.05 % Si and 0.01 % Mn, the balance being iron) were prepared under the following atomizing conditions; spray medium water pressure of 60 Kg/cm², water feed rate of 400 *l*/min, flow rate of 100 m/sec, molten metal nozzle diameter of 4 mm, equivalent diameter of the guide of 40 mm and the distance between the molten metal nozzle and the water level being 50 cm. Oxygen contents and size distributions of the resulting powders are shown in Table 2.

Table 2

| Powder | Oxygen content (ppm) | Size distribution (%) 325 mesh | 325 – 250 mesh | 250 – 200 mesh | 200 – 150 mesh | 150 – 100 mesh | 100– 60 mesh |
|---|---|---|---|---|---|---|---|
| Copper | 1310 | 56 | 14 | 8 | 9 | 7 | 6 |
| Nickel | 1320 | 48 | 16 | 5 | 9 | 12 | 12 |

Table 2-continued

| Powder | Oxygen content (ppm) | Size distribution (%) 325 mesh | 325 – 250 mesh | 250 – 200 mesh | 200 – 150 mesh | 150 – 100 mesh | 100– 60 mesh |
|---|---|---|---|---|---|---|---|
| Iron | 980 | 28 | 23 | 11 | 22 | 13 | 3 |

When copper was atomized without provision of the granulation chamber guide, the oxygen content was about 4600 ppm., and only 90 % of the molten metal was pulverized while the remaining 10 % was left in the molten metal tank because of cooling and solidification of the molten metal in the molten metal nozzle.

From the foregoing results, it will readily be understood that the apparatus of this invention is effective for atomizing not only iron and steel but also non-ferrous materials.

EXAMPLE 5

A powder of nickel-molybdenum-steel was prepared at a spray medium water pressure of 60 Kg/cm², a water feed rate of 40 *l*/min., a flow rate of 100 m/sec. and a molten metal nozzle diameter of 4 mm with use of a cylindrical guide having an octagonal cross-section and an equivalent diameter of 40 mm while adjusting the distance between the molten metal nozzle and the water level to 55 cm. The nickel-molybdenum-steel powder had a chemical composition of 0.21 % C, 0.31 % Si, 0.57 % Mn, 2.02 % Ni and 0.22 % Mo, the balance being Fe. The oxygen content of the resulting powder was 1020 ppm. and the particle size distribution was characterized by 28 % of particles of a size not exceeding 325 mesh and 57 % of particles of a size within a range of from 325 to 150 mesh.

The so obtained powder was blended for 45 minutes with 0.2 % of graphite and 1 % of zinc stearate by means of a V-type mixer. Then, the powder was packed in a mold and pressed under a pressure of 6 tons/cm² to obtain a plate having a thickness of 7 mm. The so molded plate was maintained at 1150°C. for 1 hour in a decomposing ammonia gas atmosphere to obtain a sintered body.

The resulting sintered body had a density of 6.95 g/cm³, an oxygen content of 250 ppm., a tensile strength of 85 kg/mm² and an elongation of 3 %.

EXAMPLE 6

High speed steel SKH-57 was atomized at a spray medium water pressure of 60 Kg/cm², a water feed rate 400 *l*/min and a flow rate of 80 m/sec. with use of a molten metal nozzle having a diameter of 4 mm and a guide having an equivalent diameter of 70 mm while changing the distance between the molten metal nozzle and the water level as 20, 40, 60, 80 and 200 cm.

The resulting powder was incorporated with 1 % of graphite and 1 % of zinc stearate, sufficiently mixed, packed in a mold and sintered at 110°C. in a vacuum of $10^{-4}$ mmHg for 1 hour. The resulting sintered body was hot cast at 800°C. to obtain a plate-like sintered cast product. The density ratio of the product was about 99 %. Notch-less impact test specimens were prepared from this product, and they were subjected to the impact test. For comparison, a product having an oxygen content of 50 ppm., which was prepared by the melting method, was similarly subjected to the impact test. Results are shown in Table 3, and the relation between the oxygen content and the impact value, which was observed in this Example, is shown in Table 3.

Table 3

| Distance (cm) between molten metal nozzle and water level | Oxygen content (ppm) of atomized product | Oxygen content (ppm) of sintered product | Impact value (Kg-m/cm²) |
|---|---|---|---|
| 20 | 770 | 90 | 2.3 |
| 40 | 1150 | 120 | 2.0 |
| 60 | 1350 | 150 | 1.8 |
| 80 | 1600 | 360 | 1.5 |
| 200 | 3200 | 1300 | 1.3 |
| — | — | 50* | 1.0* |

*product prepared by the melting method

From the foregoing results, it is seen that if the oxygen content of the atomized product can be maintained at a low level it is easy to obtain a sintered product of a low oxygen content and the impact value can be maintained at a level practically sufficient for a cutting tool steel. The reason why the impact value of the product of an oxygen content of 50 ppm prepared by the melting method was as low as 1.0 is believed to be that coarse carbides were distributed irregularly.

EXAMPLE 7

A molten metal of chromium-molybdenum-steel was atomized under the same conditions as adopted in Example 4. The chemical composition of the powder was 0.18 % C, 0.32 % Si, 0.54 % Mn, 1.08 % Cr, 0.22 % Mo and 0.1289 % $O_2$, the balance being Fe. The size distribution of the powder was characterized by 26 % of particles of a size not exceeding 325 mesh, 40 % of particles of a size of 325 to 200 mesh, 30 % of particles of a size of 200 to 100 mesh and 5 % of particles of a size exceeding 100 mesh. When the same molten metal was atomized without provision of the guide, the oxygen content of the resulting comparative powder was 3550 ppm., and its particle size distribution was almost the same as that of the above product.

The powder of an oxygen content of 1289 ppm was incorporated with 0.9 % of graphite and the comparative powder of an oxygen content of 3550 ppm was incorporated with 1.3 % of graphite, and each powder was compression molded into columns having a diameter of 200 mm and a height of 250 mm. The molded products were placed into a vacuum furnace maintained at $10^{-5}$ mmHg and they were vacuum sintered at 1150°C. for 3 hours.

Samples were collected from the surface portion and central portion of each sintered product, and the oxygen and carbon contents were determined by the analysis to obtain results shown in Table 4.

Table 4

| Atomized product | | Sintered product | | | |
|---|---|---|---|---|---|
| | | Surface portion | | Central portion | |
| Oxygen content (ppm) | Carbon content (ppm) | Oxygen content (ppm) | Carbon content (ppm) | Oxygen content (ppm) | Carbon content (ppm) |
| 1289 | 9000 | 89 | 8300 | 95 | 8300 |

Table 4-continued

| Atomized product | | Sintered product | | | |
|---|---|---|---|---|---|
| | | Surface portion | | Central portion | |
| Oxygen content (ppm) | Carbon content (ppm) | Oxygen content (ppm) | Carbon content (ppm) | Oxygen content (ppm) | Carbon content (ppm) |
| 3550 | 13000 | 850 | 10000 | 2900 | 11800 |

From the foregoing results, it is seen that even when columnar large molded bodies such as one having a diameter of 200 mm and a height of 250 mm are maintained at a high temperature under a vacuum of $10^{-5}$ mmHg, if their oxygen content is too high, it is impossible to reduce the oxygen content in the resulting sintered bodies.

guide and the distance between the top end of the molten metal nozzle and the liquid level of the water reservoir to 40 mm and 40 cm, respectively. Argon gas was used as the non-oxidizing gas and the gas pressure at the gas projection opening was maintained at 13 Kg/cm$^2$.

For comparison, the above procedures were conducted in the same manner without projection of argon gas or without projection of argon gas and provision of the granulation chamber.

In each case, the time required for 3 Kg of the molten metal to be flown out and powderized, the ratio of the flown molten metal and the oxygen content in the resulting powder were determined to obtain results shown in Table 6.

Table 5

| kind of steel | Chemical composition (% by weight) | | | | | | | | |
|---|---|---|---|---|---|---|---|---|---|
| | C | Si | Mn | Cr | W | Mo | V | Co | Fe |
| A | 0.82 | 0.20 | 0.33 | 4.07 | 6.35 | 4.85 | 1.88 | — | balance |
| B | 1.22 | 0.18 | 0.32 | 4.47 | 9.45 | 3.38 | 3.48 | 10.05 | balance |
| C | 4.38 | 0.20 | 0.29 | 3.80 | — | — | 20.00 | — | balance |
| D | 4.30 | 0.21 | 0.28 | 3.21 | 8.02 | 2.81 | 19.31 | 8.02 | balance |

Table 6

| | Both guide and gas projection opening provided | Only guide provided | Neither guide nor gas projection opening provided |
|---|---|---|---|
| Steel A | | | |
| oxygen content (ppm) | 280–310 | 610–760 | 3150–3500 |
| time (sec/3Kg) for flowing out molten metal | 8 | 7 | 22 |
| ratio (%) of flown molten metal | 100 | 100 | 70 |
| Steel B | | | |
| oxygen content (ppm) | 260–280 | 590–740 | 3080–3400 |
| time (sec/3Kg) for flowing out molten metal | 8 | 7 | 22 |
| ratio (%) of flown molten metal | 100 | 100 | 62 |
| Steel C | | | |
| oxygen content (ppm) | 420–490 | 800–870 | 4500–5000 |
| time (sec/3Kg) for flowing out molten metal | 10 | 10 | 31 |
| ratio (%) of flown molten metal | 100 | 100 | 40 |
| Steel D | | | |
| oxygen content (%) | 480–510 | 810–930 | 4900–5600 |
| time (sec/3Kg) for flowing out molten metal | 9 | 7 | 25 |
| ratio (%) of flown molten metal | 100 | 100 | 43 |

EXAMPLE 8

As illustrated in FIG. 4, a non-oxidizing gas projecting opening 10 was provided between a molten metal nozzle 2 and a liquid spraying nozzle 4 so that a curtain of a non-oxidizing gas was formed in the periphery of the molten metal nozzle. With use of the atomizing apparatus having the above structure, four steels indicated in Table 5 were atomized. More specifically, 3 Kg of a molten metal was charged into a molten metal tank 1 maintained at 950°C. and the atomizing was carried out at a molten metal nozzle diameter of 4 mm, a spray medium water pressure of 60 kg/cm$^2$, a water feed rate of 400 *l*/min and a flow rate of 76 cm/sec. while adjusting the equivalent diameter of the granulation chamber From the results shown in Table 6, it is seen that as compared with the conventional apparatus provided with neither the guide nor gas projecting device, improvements in the reduction of the oxygen content and the facility of atomizing operations can be attained by provision of the guide for defining a granulation chamber. If an inert gas-projecting device is further provided, the effect of reducing the oxygen content in the resulting powder is much enhanced. The time required for flowing out the molten metal is hardly influenced by provision of the inert gas-projecting device, and it has thus been confirmed that provision of the inert gas-projecting device has no bad influence on the molten metal-sucking effect by the guide.

Three kinds of powders prepared from the steel B were formed into material for sintered tool steels according to the following process (I) or (II):

Process (I): molding → hot extrusion in vacuum

Process (II): molding → hot extrusion in inert gas atmosphere

Each of the resulting materials was quenched and tempered under prescribed condition, and formed into smooth cubic speciments of a side of 5 mm. They were subjected to the bending deformation test according to the three-fulcra method in which the distance between the fulcra was adjusted to 40 mm to determine the traverse bending strength and the flexure. Results are shown in Table 7. Comparative samples prepared by the melting method were similarly tested. Results are also shown in Table 7.

Table 7

| | Both guide and gas-projecting device provided | | Only guide provided | | Neither guide nor gas-projecting device provided | | Comparative sample prepared by melting method | |
|---|---|---|---|---|---|---|---|---|
| | Traverse bending strength (Kg) | Flexure (mm) | Traverse bending strength (Kg) | Flexure (mm) | Traverse bending strength (Kg) | Flexure (mm) | Traverse bending bending (Kg) | Flexure (mm) |
| Process (I) | 480 | 1.32 | 475 | 1.31 | 270 | 0.45 | 375 | 0.90 |
| Process (II) | 470 | 1.30 | 380 | 1.00 | 160 | 0.20 | | |

It was found that when powders prepared in this Example by using the apparatus provided with either the guide or the gas-projecting opening were merely hot processed in a non-oxidizing atmosphere, materials having a sufficient toughness required for tool steels could be obtained. More specifically, the preferred embodiment of this invention illustrated in this Example is advantageous with respect to either the manufacturing process or the equipment cost, because the vacuum heat treatment need not be conducted.

We claim:

1. An apparatus for production of metal powders comprising:

a molten metal tank, molten metal nozzle means which is communicated with the tank and through which molten metal passes, annular liquid spray means surrounding the molten metal nozzle for injecting cooling liquid into said molten metal and thereby finely dividing said molten metal, a granulation chamber guide through which atomized metal particles coming from the molten metal nozzle pass, and a water tank disposed under the chamber guide with a lower end of said guide being opened into water contained in the water tank, wherein said guide is dimensioned to ensure violent movement of the finely divided metal and liquid in said guide so that vapor film of said liquid on the surfaces of said finely divided metal is promptly destroyed and a fresh portion of said liquid is contacted with the surfaces of said finely divided metal.

2. An apparatus set forth in claim 1, wherein the lower end of the granulation chamber guide is immersed in stagnant water and both the atomizing chamber and the granulation chamber are devoid of open air.

3. An apparatus set forth in claim 2 wherein the equivalent diameter of the granulation chamber guide is 10 to 80 mm and the distance between a top end of the molten metal nozzle and the level of the water is 20 to 160 cm.

4. Apparatus according to claim 1, wherein the equivalent diameter of said guide is at least 10mm, and wherein the molten metal nozzle is spaced from the water contained in said tank at least 10 cm.

5. Apparatus according to claim 1, wherein said granulation chamber guide is provided with groove means along an inside wall thereof to enhance mixing of metal and liquid from said nozzle means.

6. Apparatus according to claim 5, wherein said groove means is a spiral groove means.

7. An apparatus for production of metal powders comprising:

a molten metal tank, a molten metal nozzle which is communicated with the tank and through which molten metal passes, a liquid spray nozzle surrounding the molten metal nozzle, a non-oxidizing gas-projecting nozzle positioned between the molten metal nozzle and the liquid spray nozzle, a granulation chamber guide of limited cross-sectional area to violently mix the metal, liquid and gas coming from the molten metal nozzle, the liquid spray nozzle and the gas-projecting nozzle, respectively, and disposed to introduce the same into stagnant water in the state devoid of air, and a stagnant water tank disposed under the chamber guide with the lower end of said guide being immersed into the stagnant water in the tank.

8. An apparatus set forth in claim 7, wherein the equivalent diameter of the granulation chamber guide is 10 to 80 mm and the distance between the top end of the molten metal nozzle and the level of the stagnant liquid is 20 to 160 cm.

9. Apparatus according to claim 7, wherein the chamber guide has an equivalent diameter of at least 10mm, and wherein the molten metal nozzle is spaced from the water contained in said tank at least 10cm.

10. Apparatus for producing metal powders comprising:

molten metal spray means having an end portion from which molten metal received from molten metal supply means is sprayed, and liquid spray means arranged to direct a liquid spray which intercepts a molten metal spray from said molten metal spray means within a converging portion of an atomizing chamber which surrounds said end portion.

11. Apparatus according to claim 10, wherein said liquid spray means is annular and surrounds said molten metal spray means.

12. Apparatus according to claim 11, further comprising granulation chamber means for receiving the metal and liquid sprays from said atomizer chamber means, said granulation chamber means having a limited cross-sectional area so as to ensure turbulent mixing of said metal and liquid sprays therein.

13. Apparatus according to claim 12, wherein the converging portion of said atomizing chamber means converges in the direction of molten metal spray from said molten metal spray means.

14. Apparatus according to claim 13, further comprising liquid tank means, wherein said granulation chamber means has an end extending into said tank means.

15. Apparatus according to claim 14, wherein said tank means includes liquid therein, and wherein said end extends below the level of said liquid in said liquid tank.

16. Apparatus according to claim 13, wherein said granulation chamber means is cylindrical in cross-section and extends from a first upper end connected to said atomizing chamber to a second lower end extending into a body of liquid.

17. Apparatus according to claim 13, further comprising gas spraying means arranged between said metal spray means and said liquid spray means.

18. Apparatus according to claim 17, wherein said gas spraying means is arranged to direct a spray of gas between the intercepting liquid spray and the molten metal spray from said metal spray means.

19. Apparatus according to claim 18, wherein all of said spraying means are nozzles.

20. Apparatus according to claim 10, further comprising granulation chamber means for receiving the metal and liquid sprays from said atomizing chamber means, said granulation chamber means including a spiral groove along an inside wall thereof to enhance mixing of said sprays.

21. Apparatus according to claim 10, further comprising granulation chamber means for receiving the metal and liquid sprays from said atomizer chamber means, said granulation chamber means having a limited cross-sectional area so as to ensure turbulent mixing of said metal and liquid sprays therein.

22. Apparatus according to claim 21, wherein said limited cross-sectional area is such that violent movements of metal and liquid are caused to destroy any vapor film of the liquid formed on the metal.

23. Apparatus according to claim 22, wherein the chamber guide has an equivalent diameter of at least 10mm, and wherein the molten metal nozzle is spaced from the water contained in said tank at least 10cm.

24. Apparatus according to claim 10, wherein said molten metal spray means has a longitudinally extending opening which extends in the same direction as longitudinal granulation chamber means arranged to receive the metal and liquid sprays from the atomizing chamber means.

25. Apparatus according to claim 10, wherein said liquid spray means is annular and is located at an upper inlet end of said atomizing chamber.

26. Apparatus according to claim 10, further comprising gas spraying means arranged between said metal spray means and said liquid spray means.

* * * * *